US008365535B2

(12) United States Patent
Widener et al.

(10) Patent No.: US 8,365,535 B2
(45) Date of Patent: Feb. 5, 2013

(54) FUEL NOZZLE WITH MULTIPLE FUEL PASSAGES WITHIN A RADIAL SWIRLER

(75) Inventors: Stanley Kevin Widener, Greenville, SC (US); Scott Robert Simmons, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 1033 days.

(21) Appl. No.: 12/368,011

(22) Filed: Feb. 9, 2009

(65) Prior Publication Data

US 2010/0199674 A1 Aug. 12, 2010

(51) Int. Cl.
*F02C 1/00* (2006.01)

(52) U.S. Cl. ..... 60/742; 60/740

(58) Field of Classification Search ..... 60/737, 60/738, 739, 740, 742, 746, 748
See application file for complete search history.

(56) References Cited

U.S. PATENT DOCUMENTS

| | | | | |
|---|---|---|---|---|
| 6,282,904 | B1 | 9/2001 | Kraft et al. | |
| 6,438,961 | B2 | 8/2002 | Tuthill et al. | |
| 6,898,937 | B2 * | 5/2005 | Stuttaford et al. | 60/737 |
| 7,007,477 | B2 | 3/2006 | Widener | |
| 2001/0052229 | A1 * | 12/2001 | Tuthill et al. | 60/39.06 |

* cited by examiner

*Primary Examiner* — Ehud Gartenberg
*Assistant Examiner* — Gerald Sung
(74) *Attorney, Agent, or Firm* — Cantor Colburn LLP

(57) ABSTRACT

A fuel nozzle manifold comprising a flange, a stem and a swirler is provided. The flange has a first fluid inlet fluidly connected to a radially extending first flow passage, the stem includes at least a first axially extending and only partially circumferentially extending flow channel, and the swirler has at least a first radially extending premix passage. The flange and the stem can comprise a homogeneous component, or two separate components fluidly connecting the first axially extending flow channel to the first flow passage, to form a fluid connection between the flange and the stem, the swirler comprises another component fitted together with the flange and stem component and fluidly connecting the first premix passage and the first flow channel.

19 Claims, 11 Drawing Sheets

FUEL NOZZLE WITH MULTIPLE FUEL PASSAGES WITHIN A RADIAL SWIRLER

BACKGROUND OF THE INVENTION

The subject matter disclosed herein relates to fuel nozzles and more particularly relates to a fuel nozzle manifold having discrete passages in a single component.

The primary air polluting emissions usually produced by gas turbines burning conventional hydrocarbon fuels are oxides of nitrogen, carbon monoxide, and unburned hydrocarbons. It is well known in the art that oxidation of molecular nitrogen in air breathing engines is highly dependent upon the maximum hot gas temperature in the combustion system reaction zone. One method of controlling the temperature of the reaction zone of a heat engine combustor below the level at which thermal NOx is formed is to premix fuel and air to a lean mixture prior to combustion—often called a Dry Low Nox (DLN) combustion system. The thermal mass of the excess air present in the reaction zone of a lean premixed combustor absorbs heat and reduces the temperature rise of the products of combustion to a level where thermal NOx is significantly reduced. An example of a fuel nozzle that achieves a uniform fuel/air flow mixture through the user of a swirler is shown in FIG. 1.

FIG. 1 is a perspective view of a fuel nozzle 1 having an inlet flow conditioner 10 that provides most of the air for combustion of the nozzle. The inlet flow conditioner includes an annular flow passage 11 that is bounded by a solid cylindrical inner wall 12 at the inside diameter, a perforated cylindrical outer wall 13 at the outside diameter, and a perforated end cap 14 at the upstream end. In the center of the flow passage 11 is one or more annular turning vanes 15. Premixer air enters the inlet flow conditioner 10 from a high pressure plenum 21, which surrounds the entire assembly except the discharge end 35, through the perforations in the end cap 14 and cylindrical outer wall 13.

After combustion air exits the inlet flow conditioner 10, it enters the swirler assembly (sometimes called a swozzle assembly) 22. The swirler assembly 22 includes a hub 23 and a shroud 24 connected by a series of air foil shaped turning vanes, which impart swirl to the combustion air passing through the premixer. Each turning vane contains a first fluid supply passage 25 and a second fluid supply passage 26 through the core of the air foil. These fluid supply passages distribute fuel and/or air to first fuel injection holes (not shown) and second injection holes (also not shown), which penetrate the wall of the air foil. These fuel injection holes may be located on the pressure side, the suction side, or both sides of the turning vanes. Fuel enters the swirler assembly 22 through inlet ports 31 and annular passages 32, 33, which feed the fluid supply passages 25, 26 within the turning vanes. Fuel begins mixing with combustion air in the swirler assembly 22, and fuel/air mixing is completed in the annular passage 34. After exiting the annular passage 34, the fuel/air mixture enters the combustor reaction zone 35 where combustion takes place.

At the center of the nozzle assembly is a conventional diffusion flame fuel nozzle 41 having a slotted gas tip 42, which receives combustion air from an annular passage 43 and fuel through gas holes 44. The body of this fuel nozzle includes a bellows 45 to compensate for differential thermal expansions between this nozzle and the premixer.

The multiple concentric tube design of FIG. 1 typically used to transfer fuel and air in different circuits works fairly well for a few circuits, but gets difficult to package and ensure durability as the number of circuits increase. As a result, circuit designs become limited. Furthermore, due to the fluids flowing on either side of multiple thin concentric tubes making up most fuel nozzles, the metals of these tubes are at different metal temperatures. The differential temperatures of the separate metal tubes cause thermal strain at the tube connections, which are typically brazed. Axial strain is also a problem. While axial strain can be relieved by an expansion joint, such as a bellows or other suitable device, it adds cost to the nozzle and causes packaging restrictions. Radial strain of the thin metal tubes of a fuel nozzle is also a concern at nozzle design temperatures, but radial strain is typically difficult to mitigate.

While thin metal tubing does provide some bending stiffness, it is typically at risk for being driven at a bending resonance by the turbine within which the nozzle is used. Finally, the axial separation between the outlets of the fuel circuits can severely restrict the design of the joints separating the circuits. The resulting joint may compromise durability.

BRIEF DESCRIPTION OF THE INVENTION

According to one aspect of the invention, a fuel nozzle is provided. The nozzle includes a burner tube having a nozzle tip disposed therein. A flange is connected to the burner tube and has a first and a second fluid inlet that is fluidly connected to a first and a second flow passage, respectively. A stem, having at least a first and a second generally axially extending flow channel is also provided. The flow channels of the stem are circumferentially disposed from each other and are fluidly connected to the first and the second flow passages, respectively. A swirler is also included. It has at least a first and a second radially extending premix passage, each of the premix passages are fluidly connected to the first and second flow channels, respectively, the flange and the stem comprising a single component.

According to another aspect of the invention, a fuel nozzle manifold for use in a fuel nozzle, is provided. It includes a flange having a first and a second fluid inlet fluidly connected to a first and a second flow passage, respectively, and a generally axially extending stem having at least a first and a second flow channel, said first flow channel eccentrically disposed from said second flow channel relative to said stem axis. A swirler having a plurality of radially extending vanes is provided. Each of the vanes has at least a first and a second radially extending premix passage therein, the premix passages are fluidly connected to the first and second flow channels, respectively. The flange and the stem each comprise a separate component fitted together and fluidly connecting the flow channels to the first and second flow passages, respectively, to form a fluid connection between the flange and the stem.

According to yet another aspect of the invention a fuel nozzle manifold comprising a flange, a stem and a swirler is provided. The flange has a first fluid inlet fluidly connected to a radially extending first flow passage, the stem includes at least a first axially extending and only partially circumferentially extending flow channel, and the swirler has at least a first radially extending premix passage. The flange and the stem comprise a first homogeneous component fluidly connecting the first axially extending flow channel to the first flow passage, to form a fluid connection between the flange and the stem, the swirler comprises a second component fitted together with the first component and fluidly connecting the first premix passage and the first flow channel.

These and other advantages and features will become more apparent from the following description taken in conjunction with the drawings.

BRIEF DESCRIPTION OF THE DRAWING

The subject matter which is regarded as the invention is particularly pointed out and distinctly claimed in the claims at the conclusion of the specification. The foregoing and other features, and advantages of the invention are apparent from the following detailed description taken in conjunction with the accompanying drawings in which:

Figure 1:
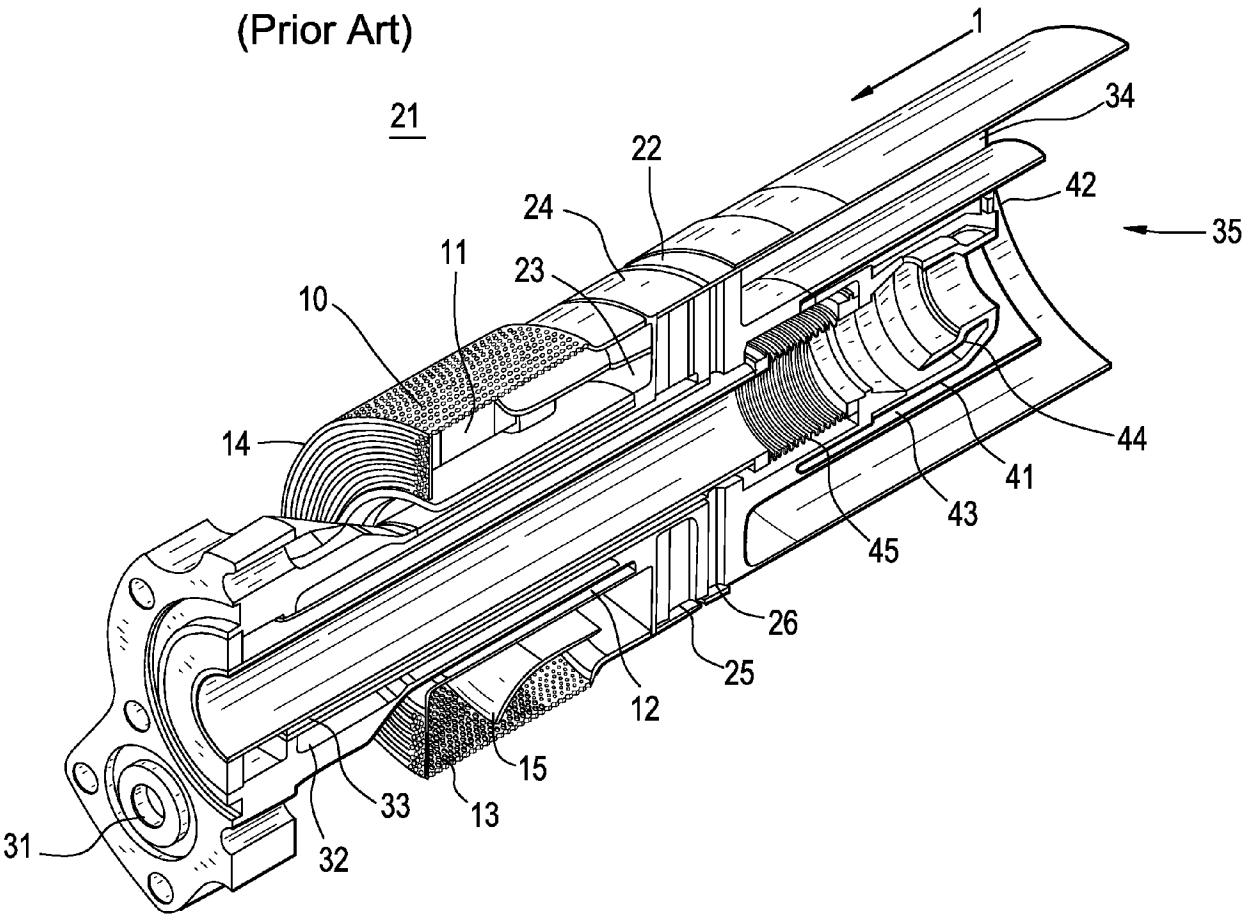
FIG. 1 (Prior Art)
FIG. 1 is a perspective view, in cross-section, of a prior art fuel nozzle.

The detailed description explains embodiments of the invention, together with advantages and features, by way of example with reference to the drawings.

DETAILED DESCRIPTION OF THE INVENTION

Referring now to FIGS. 2-6, where the invention will be described with reference to specific embodiments, without limiting same, a cross-section through a fuel nozzle 100 is shown. Fuel nozzle 100 includes a burner tube 101 lying on a central axis A and connected to a flange 102 having a stem portion 103. The flange 102 and stem portion 103 include a fluidly connected axially extending fuel cartridge orifice 104 defined by an outer circumferential surface 105 of the cartridge orifice 104 extending between an entrance end opening 106 and an exit end opening 108 of cartridge orifice 104.

The flange 102 includes an outer peripheral surface 111 extending between an outer end 112 and an inner end 113, to which burner tube 101 is attached. Stem 103 extends from a filleted region 114 of flange 102. Stem 103 includes an outer circumferential surface 115, which converges to a counterbore 121. Extending therefrom is a spindle region 122 having a generally axially extending outer circumferential surface 123. Circumferential surface 123 extends to an end annular face 124 at exit opening 107.

Figure 2:
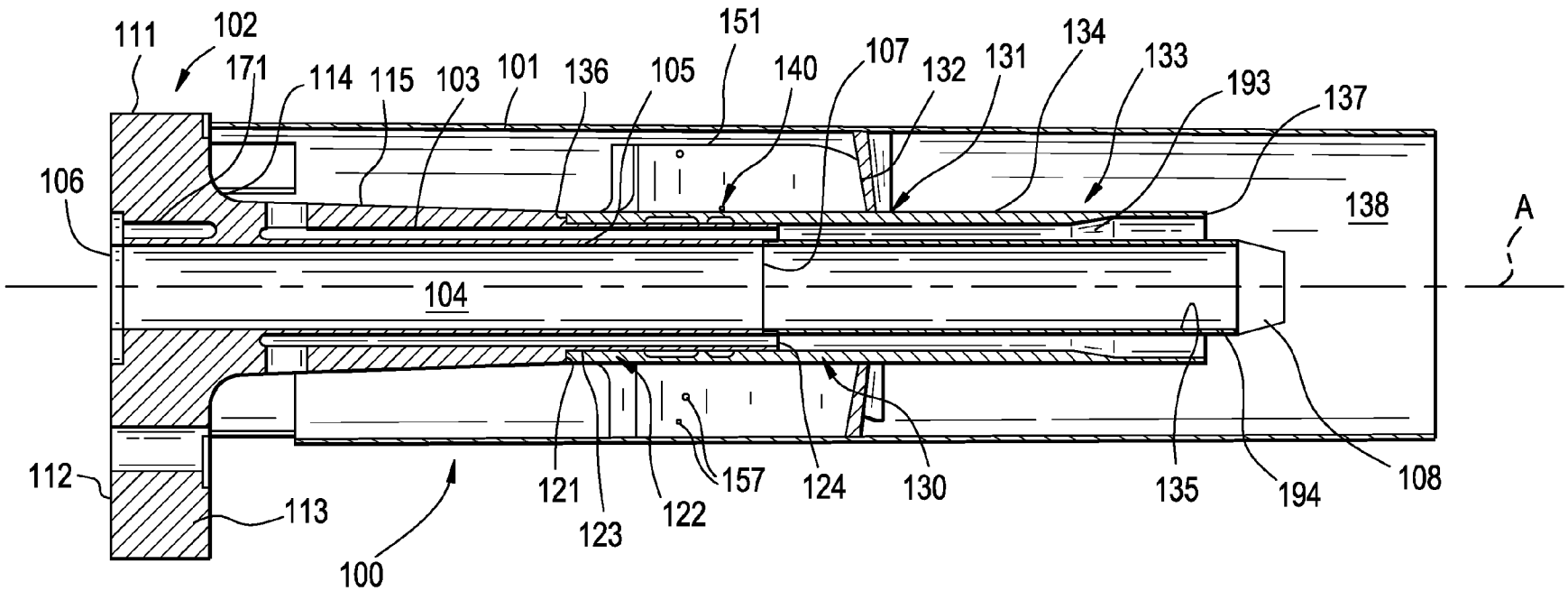
FIG. 2 is a cross-section of a fuel nozzle in accordance with the present invention.
Figure 5:
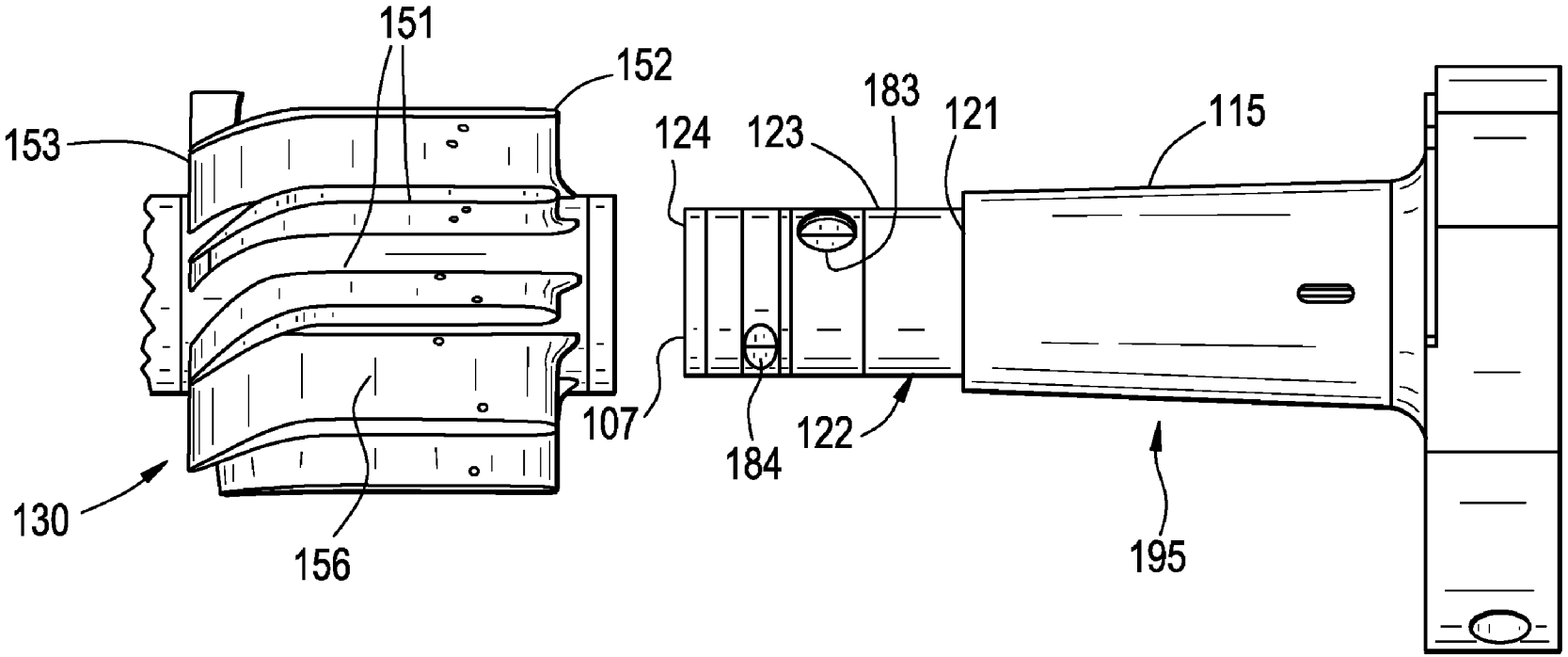
FIG. 5 is an exploded view of a portion of the fuel nozzle, in accordance with the present invention.
Figure 6:
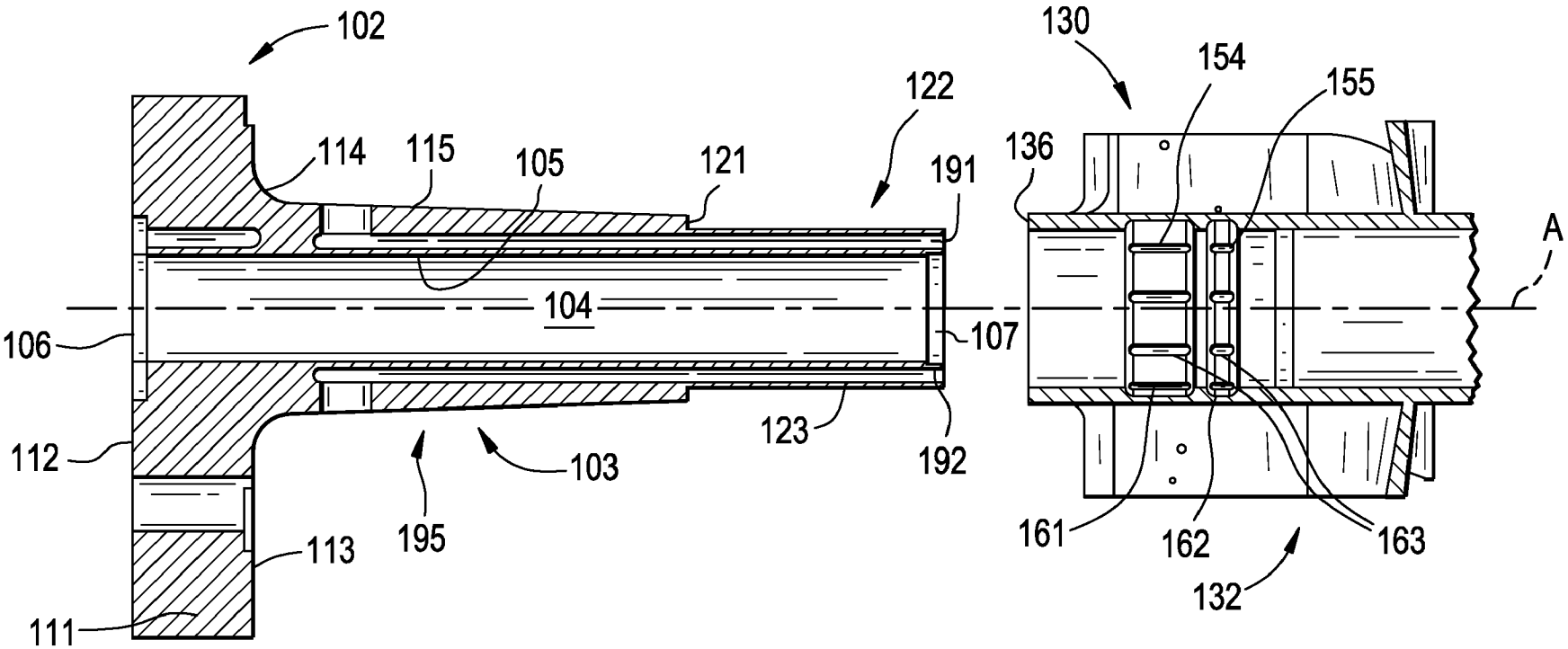
FIG. 6 is an exploded view, in cross-section, of the portion of the fuel nozzle seen in FIG. 5.

As shown in FIGS. 2, 5 and 6, a swirler (sometimes known as a swozzle) 130 is shown connected to spindle region 122 of stem portion 103. Swirler 130 includes an axially extending hub portion 131 having a mid-region 132 and an end region 133. Hub portion 131 includes an outer circumferential surface 134 and an inner circumferential surface 135 concentric with central axis A, and extending between an annular abutment face 136 in mid-region 132 and an annular end face 137 in end region 133 adjacent a flame zone 138 within burner tube 101. A nozzle tip 108 is disposed adjacent flame zone 138. Nozzle tip 108 has been omitted from all but FIG. 2 for clarity.

Swirler 130 is connected to stem portion 103 to form a manifold 140. In particular, annular abutment face 136 coacts with counterbore 121, and an outer circumferential surface 123 of spindle portion 122 is in substantial engaging contact with inner circumferential surface 135 in mid-region 132 of swirler 130.

Extending from outer circumferential surface 134 and hub portion 131 are a plurality of swirler vanes 151. As known in the art, swirler vanes have an airfoil shaped outer surface 156 with a leading edge 152 having a larger cross-sectional profile than a trailing edge 153. Swirler vanes 151 extend radially from outer circumferential surface 134 and have complex outer surfaces 156 for imparting a non-uniform airflow distribution across the vanes 151.

Each of vanes 151 includes hollow interior regions defined as a first outer premix passages 154 and a second inner premix passage 155. Each of vanes 151 includes a plurality of orifices 157 extending between the premix passages 154 and 155 and the outer surface 156. Inner circumferential surface 135 includes a first outer and a second inner plenum 161 and 162, respectively, which are in the shape of circumferential grooves. As best seen in FIG. 6, premix passages 154 and 155 are fluidly connected to first and second plenums 161 and 162 by outlet orifices 163.

Figure 4:
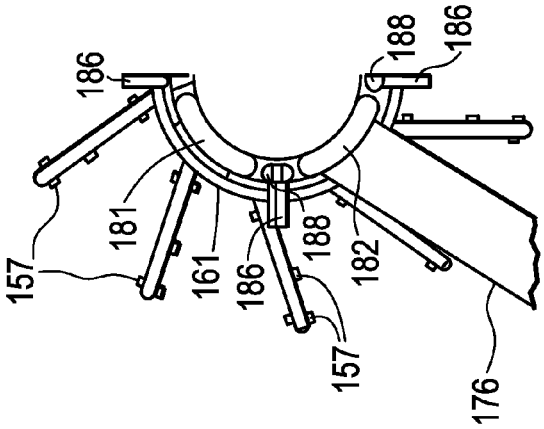
FIG. 4 is a partial end view of the flow circuits of FIG. 3.
Figure 3:
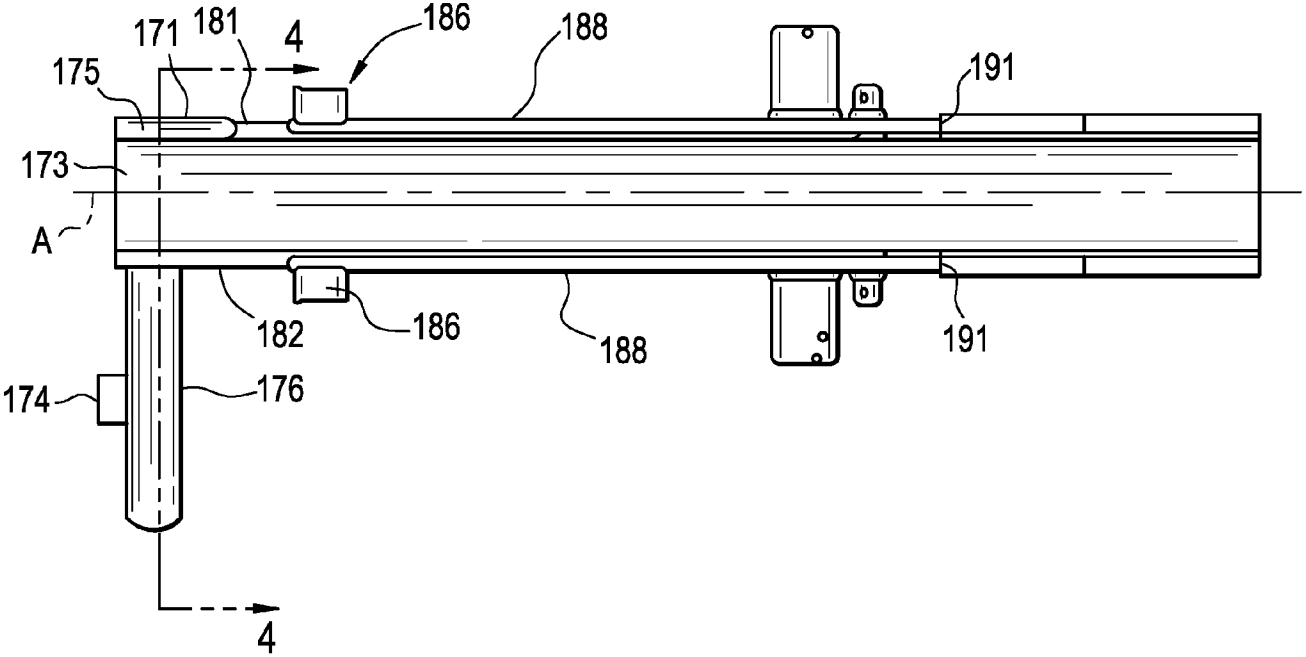
FIG. 3 depicts nested flow circuits of the nozzle of FIG. 2, in accordance with the present invention.

The flow circuits of the present invention will now be described. Flow circuits are located within manifold 140. FIGS. 3 and 4 have been developed to show the flow circuits, absent structure, in order to aid in understanding the invention. For clarity, the flow circuits within manifold 140 will be described with reference to FIGS. 5 and 6 interchangeably with the flow circuits shown in FIGS. 3 and 4 and with the same reference numerals. The flange 102 includes a first outer premix fluid inlet 171 located on the outer circumferential face 111 of flange 102. A cartridge orifice inlet 173 and an inner premix fluid inlet 174 are located on the outer end 112 of flange 102. Inlet 171 is in fluid connection with circumferentially extending outer premix flow passage 175, while inlet 174 is in fluid connection with radially extending inner premix flow passage 176.

Stem portion 103 includes a plurality of generally axially extending outer premix flow channels 181 that are fluidly connected to outer premix flow passage 175 and are each discrete flow channels circumferentially disposed from each other and eccentrically disposed from central axis A. As used herein, eccentric or eccentrically disposed means that the flow channels are not disposed about a central axis, but instead have a center that is offset from the central axis A of fuel nozzle 100. It is contemplated that three discrete flow channels 181 extend from outer premix flow passage 175, one of those flow passages shown in FIGS. 3 and 4. Furthermore, stem portion 103 includes a generally axially extending inner premix flow channel 182 that is fluidly connected to inner premix flow passage 176 and is eccentrically disposed from both central axis A and from outer premix flow channels 181. As best seen in FIGS. 3-6, premix flow channels 181 and 182 terminate at orifice openings 183 and 184, respectively on spindle portion 122. When stem portion 103 is attached to swirler 130, orifices 183 and 184 communicate with plenums 161 and 162, respectively enabling fluid communication between flow channels 181 and 182 and premix passages 154 and 155, respectively through plenums 161 and 162.

Diffusion air is introduced in to stem portion 103 through radially extending diffusion air flow passages 186 As best seen in FIG. 4, there are three flow passages 186, each individually fluidly connected to a three axially extending diffusion flow channels 188. Diffusion flow channels 188 are eccentrically disposed relative to central axis A and relative to flow channels 181 and 182. Diffusion flow channels 188 terminate at orifice openings 191 in annular end face 124. Thereafter, diffusion air is allowed to flow along a diffusion air annulus 193, as seen in FIG. 2, within the hub portion 131, defined between a diffusion tube 194 disposed within cartridge orifice 104 and the inner circumferential surface 135 of hub portion 131 until diffusion air exits into flame zone 138.

The manifold 140 of the present invention uses circumferentially separated fuel and air flow channels 181, 182and 188 in a thick walled single stem component 195 comprising flange 102 and stem portion 103 to form the flow circuits. These separate flow channels are eccentric relative to the central axis A and thus allow multiple configurations. In the embodiment of FIGS. 2 through 6, each of flange 102 and stem 103 comprise a single component fitted together, allowing the unique configuration of flow circuits. The single component of each of flange 102 and 103 may be formed by investment casting so that each is a single integral component, by welding discrete individual pieces to form a single component or by other known manufacturing methods. Indeed, the entirety of manifold 140 may be formed into a single component during manufacture, such as by investment casting, die-casting or one of the other methods of manufacture described herein or as known in the art.

Fuel enters flow passages 175 and 176, while diffusion air enters flow passages 186 within stem component 195 through both flange 102 and stem portion 103. Fuel exits the passages 175, 176, into axially separated flow channels 181 and 182 that feed plenums 161 and 162 and that further feed the individual premix passages 154 and 155 within swirler vanes 151. Diffusion air enters into the axially separated flow channels 188 that feed the diffusion air annulus 193.

The thick walled stem component 195 improves thermal strain due to temperature gradients within a fuel nozzle. Specifically, wall thickness and separation of hot and cold circuits minimizes thermal strain. Labor and part count are also drastically reduced by manifold 140. It will be appreciated that manifold 140 comprises stem component 195 and swirler 130, which is also a single component casting that has been manufactured into an integral component, such as by investment casting, die-casting, by welding discrete individual pieces to form a single component or by other known manufacturing methods. Manifold 140 allows bellows 45, as shown in FIG. 1, to be eliminated as well as the multiple concentric tubes and the brazing required to connect the concentric tubes. In addition, the thick walled component manifold 140 provides significant bending stiffness. It will be appreciated that since the flow circuits are separated axially, flow channels 181, 182 and 188 comprise an uninterrupted braze area, eliminating the stress concentrations inherent in attaching thin-walled tubes together.

Figure 7:
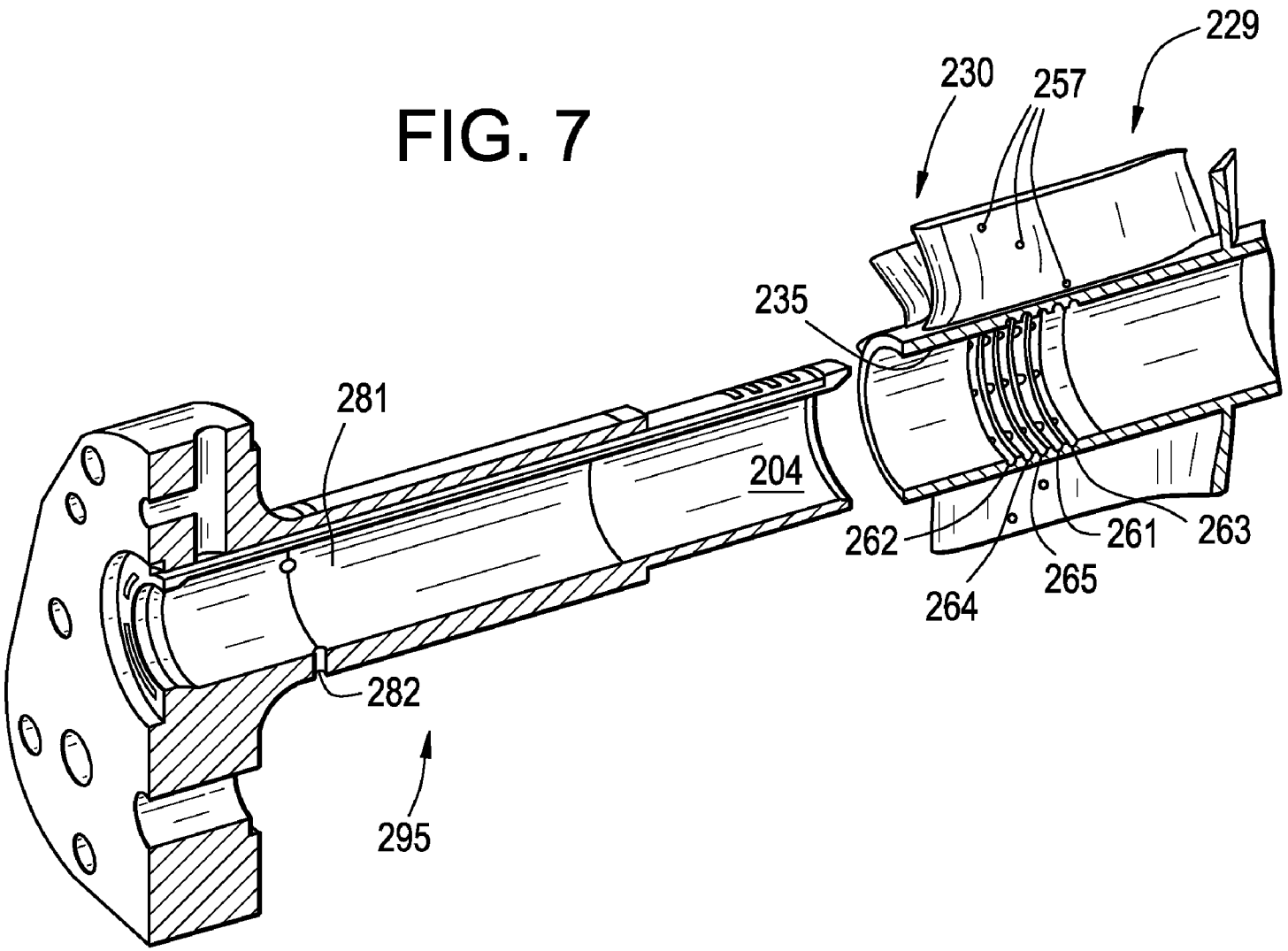
FIG. 7 is an exploded view, in cross-section, of another embodiment of the present invention.
Figure 8:
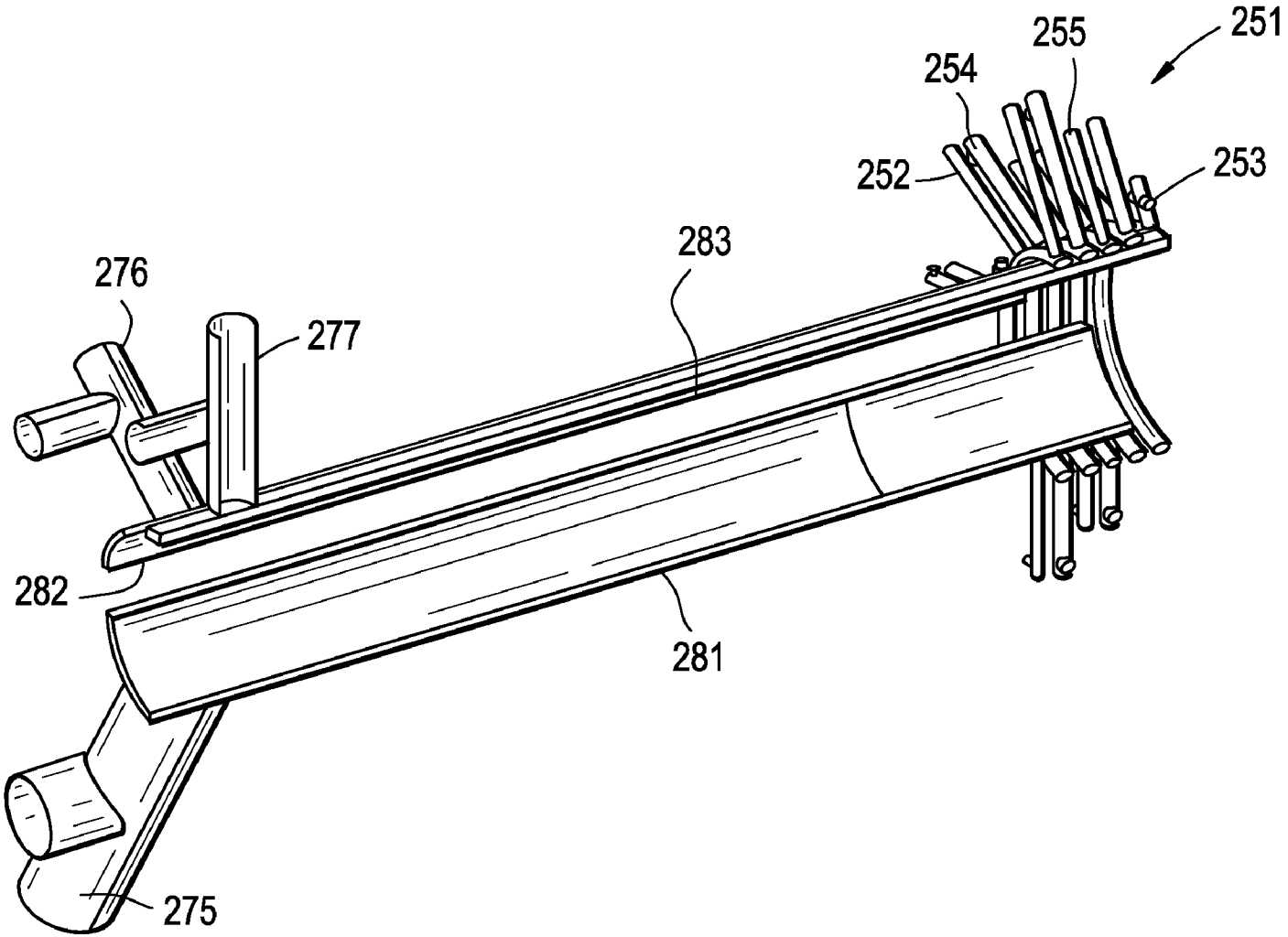
FIG. 8 is a flow circuit of the embodiment of FIG. 7.

Referring now to FIGS. 7 and 8 showing another embodiment of the present invention and where like elements are referenced by like numerals, stem component 295 includes multiple flow passages 275, 276 and 277. Passages 275, 276 and 277 feed multiple flow channels 281, 282 and 283, respectively. Flow channels 281, 282 and 283 feed and are in communication with the fuel plenums (or annular chambers) 261, 262 and 263, respectively located on the inner circumferential face 235 of swirler 230, the plenums being in the shape of circumferential grooves. Additional fuel plenums 264 and 265 of swirler 230 are fed by flow channels (not shown).

It will be appreciated that any number of flow channels and fuel plenums can be accommodated within a stem component 195 or 295 of the present invention. Furthermore, flow channels may communicate with individual flow plenums or with multiple selected flow plenums. In the present embodiment, fuel plenums 261, 262, 263, 264 and 265 communicate with individual premix passages 251, 252, 253, 254, and 255, extending from fuel plenums 261, 262, 263, 264 and 265, respectively. Multiple premix passages may extend from each fuel plenum. For example, multiple premix flow passages 252 extend from fuel plenum 262, as shown in FIG. 8. Each of the premix passages 251, 252, 253, 254, and 255 terminate in individual outlet orifices 257. This "highly tunable" embodiment is intended to provide a very flexible fuel nozzle, which can direct fuel flow split independently to a a suction side of swirler vane 229 (where pressure flow is reduced) and/or a pressure side of swirler vanes 229, (where pressure flow is compressed) as well as radially at an inner, a center and/or an outer location on each of swirler vanes 229. This flexibility allows the system to explore many different fuel mixing strategies, which may provide a benefit in the trade-off of emissions, output and efficiency. Local "sweet spots" can be built into less complicated fuel nozzles and advance the art in combustion efficiency, output and emissions.

In addition, the embodiment of FIGS. 7 and 8 show a more conventional arrangement for diffusion air within stem component 295. Diffusion air is introduced into stem component 295 through flow passages 281 and 282. Thereafter, diffusion air is allowed to flow circumferentially within cartridge orifice 204.

Figure 9:
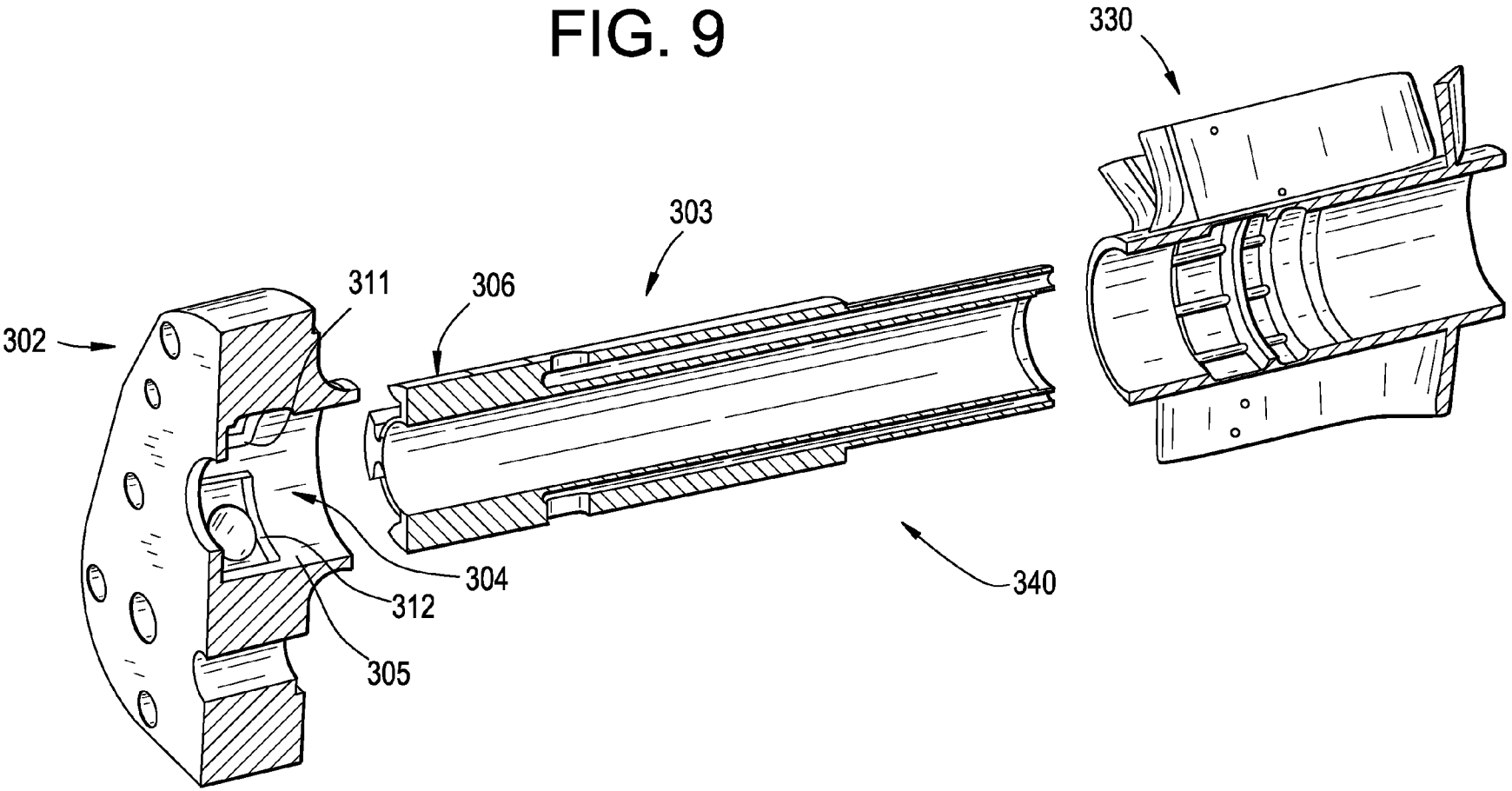
FIG. 9 is an exploded view, in cross-section, of yet another embodiment of the present invention.
Figure 10:
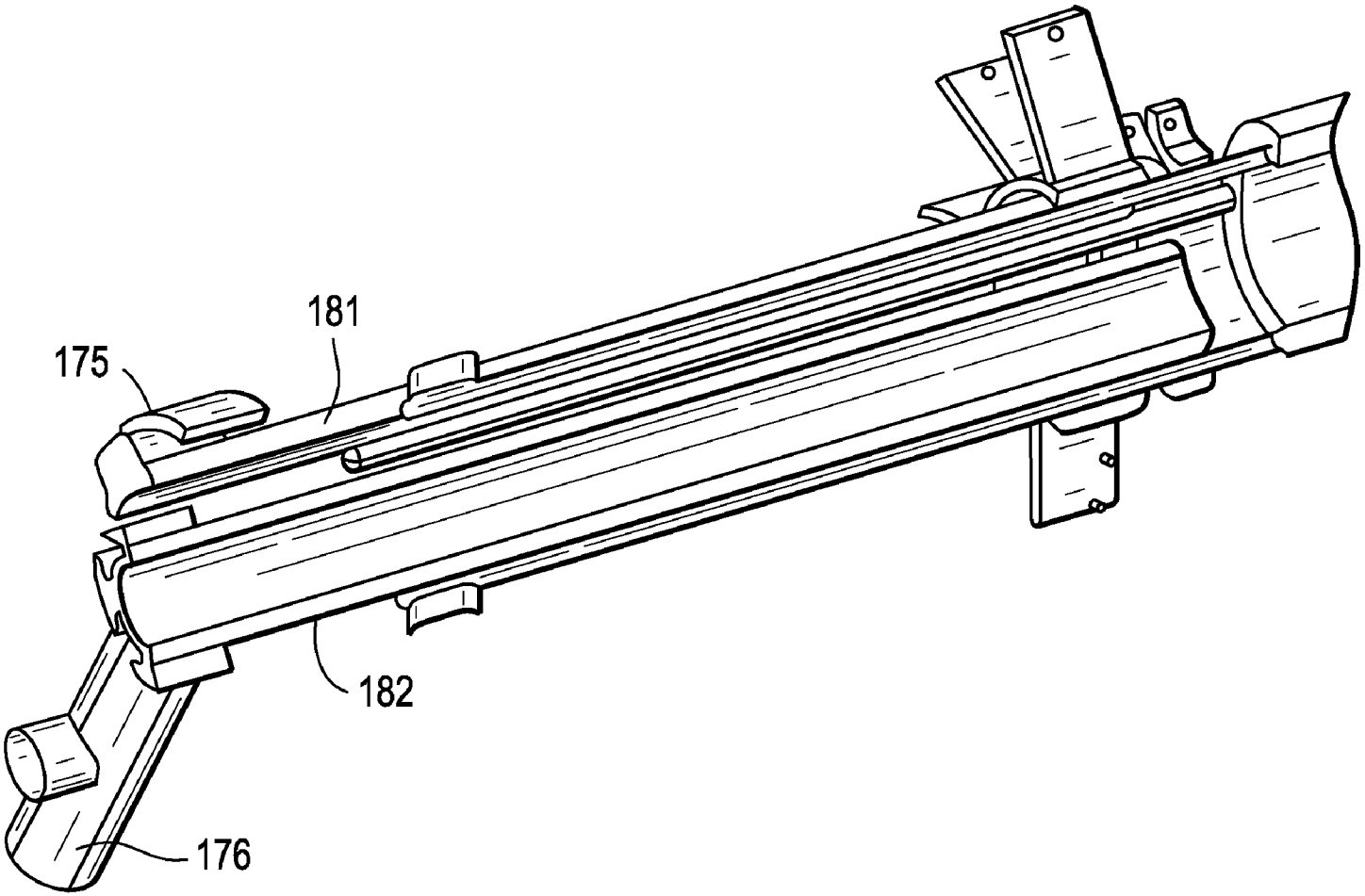
FIG. 10 is a flow circuit of the embodiment shown in FIG. 9.

In the embodiment of FIGS. 9 and 10, flange 302 and stem portion 303 each form independent components. The independent components of flange 302, stem portion 303 and swirler component 330, when fitted together, form a manifold 340. In order to accommodate this change, an outer premix fuel plenum or annular chamber 311 and an inner premix fuel plenum or annular chamber 312 are interposed between radially extending flow passages 175 and 176 and axially extending flow channels 181 and 182, respectively. Flange 302 includes a socket portion 304 having an inner circumferential surface 305 within which depressions are molded to form the fuel plenums 311 and 312. When assembled, socket portion 303 accepts a sleeve portion 306 of stem portion 303 in order that fuel plenums 311 and 312 are in fluid communication with flow channels 181 and 182, respectively.

Figure 11:
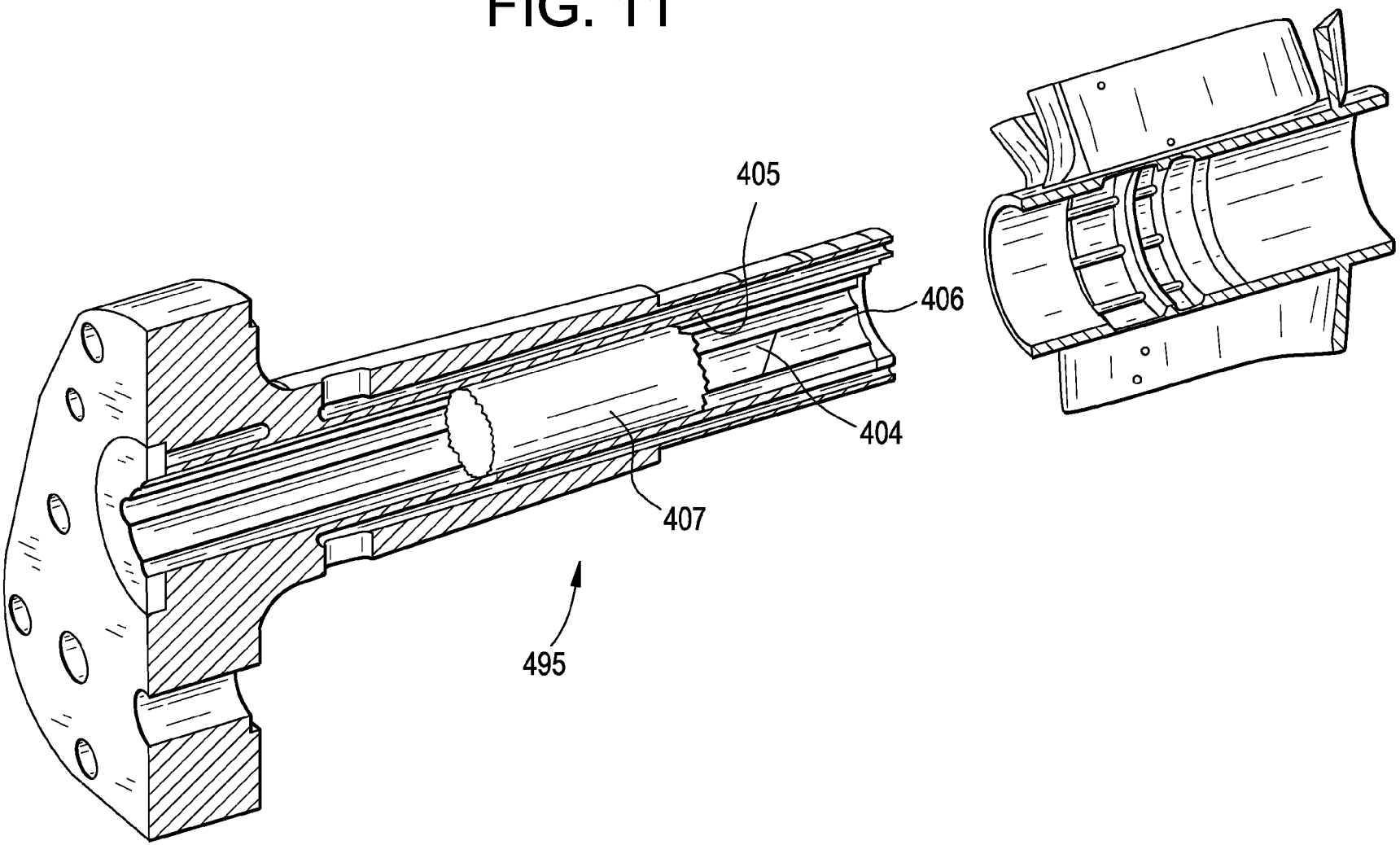
FIG. 11 is an exploded view, in cross-section, of still yet another embodiment of the present invention.
Figure 12:
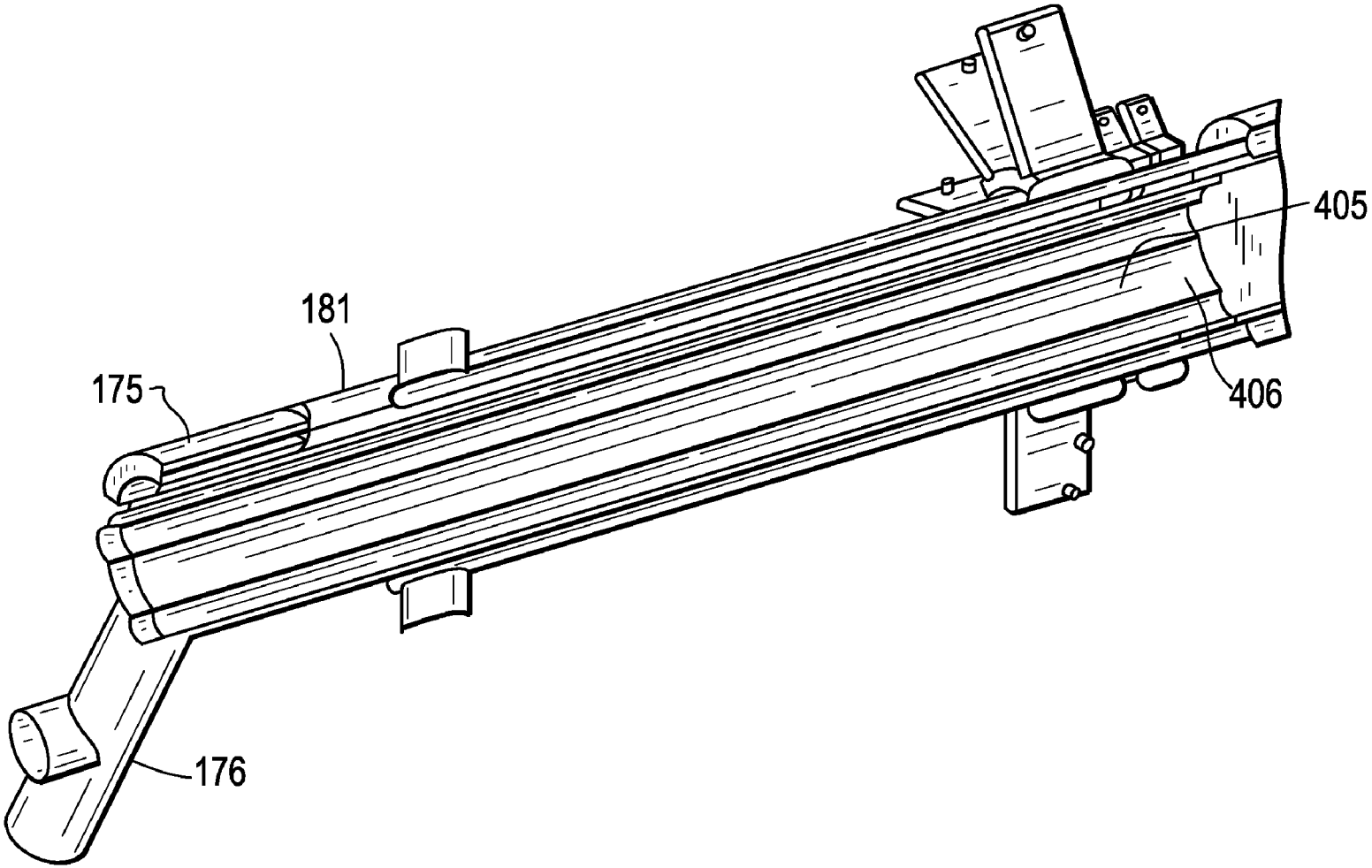
FIG. 12 is a flow circuit of the embodiment shown in FIG. 11.

In still yet another embodiment, shown in FIGS. 11 and 12, the stem component 495 has a diffusion fuel cartridge orifice 404 defined by a series of inner circumferential ridges 405 and a series of axially extending concave grooves 406 separating ridges 405. Inner ridges 405 define an inner diameter of orifice 404 while the series of axially extending concave grooves 406define the outer diameter of fuel cartridge orifice 404. Inner ridges 405 provide additional rigidity for supporting a diffusion fuel cartridge 407, shown as a partial cut-away in FIG. 11, and an even higher bending stiffness, which increases the fuel nozzle fundamental bending frequency.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A fuel nozzle comprising;

a burner tube having a central axis and a nozzle tip disposed therein;

a flange connected to said burner tube and having a first and a second fluid inlet fluidly connected to a first and a second flow passage, respectively;

a stem having at least a first and a second generally axially extending flow channel, each said flow channel circumferentially disposed from each other and fluidly connected to said at least first and second flow passages, respectively;

a swirler having at least a first and a second radially extending premix passage, each said premix passage fluidly connected to said at least first and second flow channels, respectively;

said flange and said stem each comprising a single component, wherein said stem includes a third generally axially extending flow channel, extending between a third radially extending flow passage and an annular chamber on an inner surface of said stem, said third channel fluidly connected to said third flow passage and said annular chamber wherein at least one of the first, second and third flow channels is only partially circumferentially extending.

2. The fuel nozzle of claim 1, wherein said swirler is a single component, fitted together with said stem.

3. The fuel nozzle of claim 1, wherein said first and second flow passages radially feed said first and second flow channels.

4. The fuel nozzle of claim 1, wherein said swirler includes a plurality of vanes, each of said vanes having at least one of said at least first or said second radially extending premix passages, each of said vanes including at least a first orifice and a second orifice on an outer surface, each of said at least first and second orifices fluidly connected to only one of said at least first and second premix passages.

5. The fuel nozzle of claim 1, wherein said third flow channel is eccentrically disposed from said central axis.

6. The fuel nozzle of claim 1, including a first plenum fluidly connected to said first flow channel and to said first premix passage.

7. The fuel nozzle of claim 6, including a second plenum fluidly connected to said second flow channel and to said second premix passage.

8. A fuel nozzle comprising;

a burner tube having a central axis and a nozzle tip disposed therein;

a flange connected to said burner tube and having a first and a second fluid inlet fluidly connected to a first and a second flow passage, respectively;

a stem having at least a first and a second generally axially extending flow channel, each said flow channel circumferentially disposed from each other and fluidly connected to said at least first and second flow passages, respectively;

a swirler having at least a first and a second radially extending premix passage, each said premix passage fluidly connected to said at least first and second flow channels, respectively;

said flange and said stem each comprising a single component;

a first plenum fluidly connected to said first flow channel and to said first premix passage;

a second plenum fluidly connected to said second flow channel and to said second premix passage and said swirler has an inner surface for communicating with said stem, said first and second plenums each comprising an at least partially extending circumferential groove on said inner surface.

9. A fuel nozzle comprising;

a burner tube having a central axis and a nozzle tip disposed therein;

a flange connected to said burner tube and having a first and a second fluid inlet fluidly connected to a first and a second flow passage, respectively;

a stem having at least a first and a second generally axially extending flow channel, each said flow channel circumferentially disposed from each other and fluidly connected to said at least first and second flow passages, respectively;

a swirler having at least a first and a second radially extending premix passage, each said premix passage fluidly connected to said at least first and second flow channels, respectively;

said flange and said stem each comprising a single component, said flange and said stem each include a fluidly connected axially extending fuel cartridge orifice, said orifice defined by an outer surface comprising a series of axially extending concave ridges.

10. A fuel nozzle manifold for use in a fuel nozzle, comprising;

a flange portion having first and second fluid inlets fluidly connected to a first and a second flow passage, respectively;

a generally axially extending stem portion having at least a first and a second flow channel, said first flow channel eccentrically disposed from said second flow channel relative to said stem axis;

a swirler portion having a plurality of radially extending vanes, each of said vanes having at least a first and a second radially extending premix passage therein, each said premix passage fluidly connected to said at least first and second flow channels, respectively;

said flange portion and said stem portion each comprising a separate component fitted together and fluidly connecting said flow channels to said at least first and second flow passages, respectively, to form a fluid connection between said flange and said stem.

11. The fuel nozzle manifold of claim 10, wherein said one of said stem portion and said flange portion includes a socket portion and the other of said stem and flange portions includes a sleeve, said sleeve fitted within said socket for forming said fluid connection between said flange portion and said stem portion.

12. The fuel nozzle manifold of claim 11, wherein said flange portion comprises said socket portion and said stem portion comprises said sleeve portion.

13. The fuel nozzle manifold of claim 10, wherein said first and second flow passages radially feed said first and second flow channels.

14. The fuel nozzle manifold of claim 10, wherein each of said vanes includes a plurality of orifices and each of said orifices are fluidly connected to one of said first and said second radially extending premix passages.

15. The fuel nozzle manifold of claim 10, including a first and a second plenum, said first plenum fluidly connected to said first flow channel and to said first premix passage, said second plenum fluidly connected to said second flow channel and to said second premix passage.

16. The fuel nozzle manifold of claim 15, wherein said swirler has an inner surface for engaging with a circumferential outer surface of said stem, said first and second plenums each comprising an at least partially extending circumferential groove on said inner surface.

17. The fuel nozzle manifold of claim 10, wherein said stem portion includes a third generally axially extending flow channel, extending between a third radially extending flow passage and an annular chamber on an inner surface of said stem portion, said third channel fluidly connected to said third flow passage and said annular chamber.

18. A fuel nozzle manifold comprising;

a flange having first fluid inlets fluidly connected to a radially extending first flow passage;

a stem portion having at least a first axially extending and only partially circumferentially extending flow channel;

a swirler having at least a first radially extending premix passage;

said flange and said stem comprise a first homogeneous component fluidly connecting said first axially extending flow channel to said first flow passage, to form a fluid connection between said flange and said stem, said swirler comprising a second component fitted together with said first component and fluidly connecting the first premix passage and said first flow channel.

19. The fuel nozzle manifold of claim 18, wherein said stem portion includes an axially extending spindle portion and said swirler includes a hub portion, said spindle portion fitted into said hub portion.

* * * * *